United States Patent [19]

Damrau et al.

[11] Patent Number: 4,534,309

[45] Date of Patent: Aug. 13, 1985

[54] PAPER COATING APPARATUS

[75] Inventors: Wayne A. Damrau; William C. Vreeland, both of Wisconsin Rapids, Wis.; Richard Bernert, Giengen; Albert Wöhrle, Heidenheim, both of Fed. Rep. of Germany

[73] Assignees: Consolidated Papers, Inc., Wisconsin Rapids, Wis.; J. M. Voith GmbH, Heidenheim, Fed. Rep. of Germany

[21] Appl. No.: 552,758

[22] Filed: Nov. 17, 1983

[51] Int. Cl.[3] ..... B05C 5/02

[52] U.S. Cl. ..... 118/410; 118/413

[58] Field of Search ..... 118/407, 410, 411, 413, 118/DIG. 4

[56] References Cited

U.S. PATENT DOCUMENTS

| | | | |
|---|---|---|---|
| 973,649 | 10/1910 | Goldsmith | 118/410 X |
| 1,851,538 | 3/1932 | Day et al. | 118/410 X |
| 3,418,970 | 12/1968 | Phelps et al. | 118/410 |
| 3,876,465 | 4/1975 | Prazak, III | 118/DIG. 4 |
| 4,250,211 | 2/1981 | Damrau et al. | 427/356 |
| 4,452,833 | 6/1984 | Holt | 118/410 X |

FOREIGN PATENT DOCUMENTS

| | | | |
|---|---|---|---|
| 51-2937 | 1/1976 | Japan | 118/410 |
| 302432 | 4/1971 | U.S.S.R. | 118/63 |

*Primary Examiner*—John P. McIntosh

*Attorney, Agent, or Firm*—Gary, Juettner & Pyle

[57] ABSTRACT

An improved paper coating applicator has a body portion defined by forward and rearward relatively movable walls defining a chamber therebetween with an elongate opening thereto positionable generally below, adjacent to and transversely of a paper web, the chamber receiving coating liquid and directing the same generally upwardly through the opening and onto the web. According to one aspect of the improvement, the chamber and a distribution header for introducing coating material therein are of a design enhancing a very uniform application of coating material onto the web. In another aspect, a unique seal structure provides a secure, fluid tight connection between the front and rear walls.

12 Claims, 3 Drawing Figures

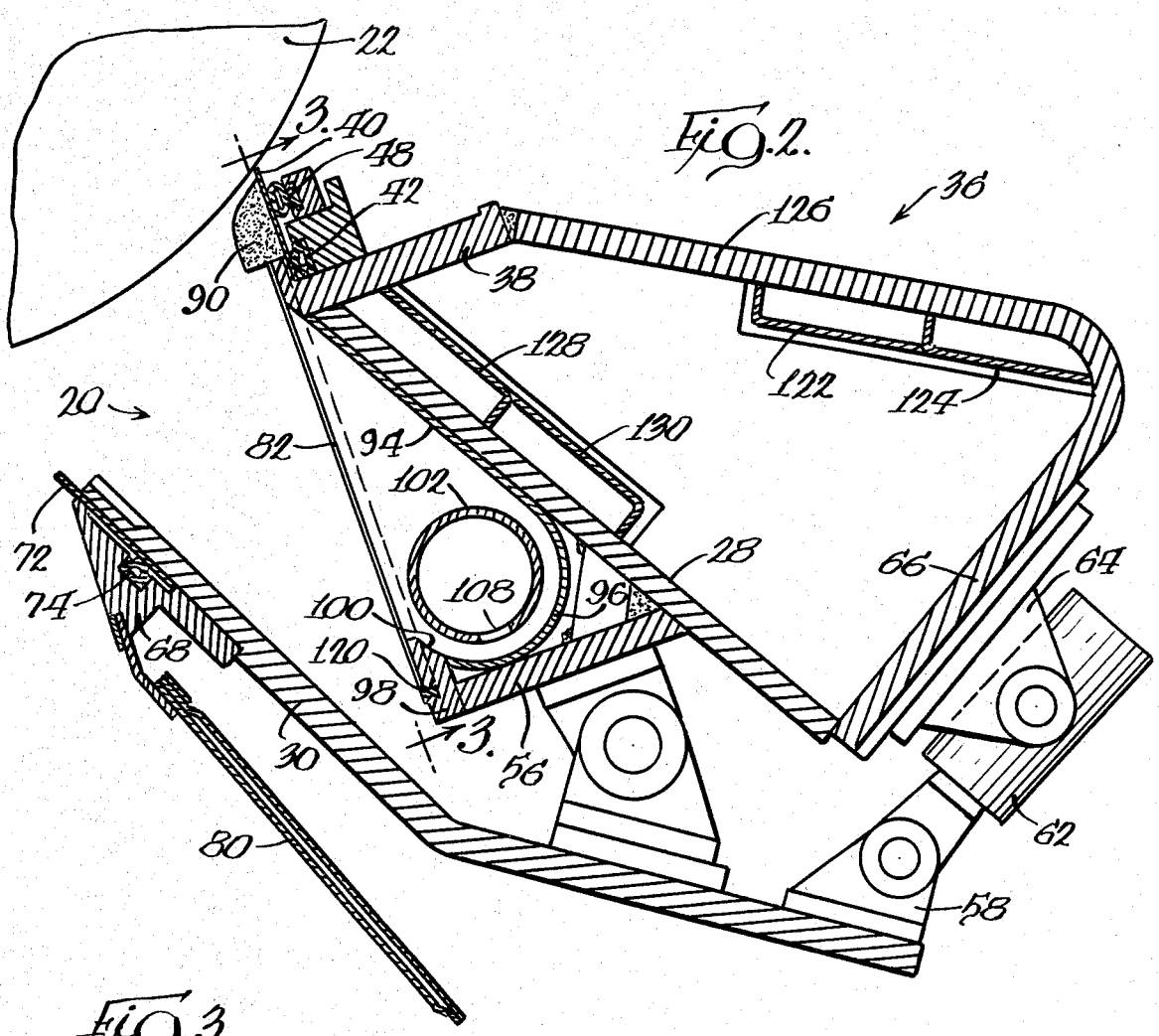
Fig. 2.
Fig. 3.
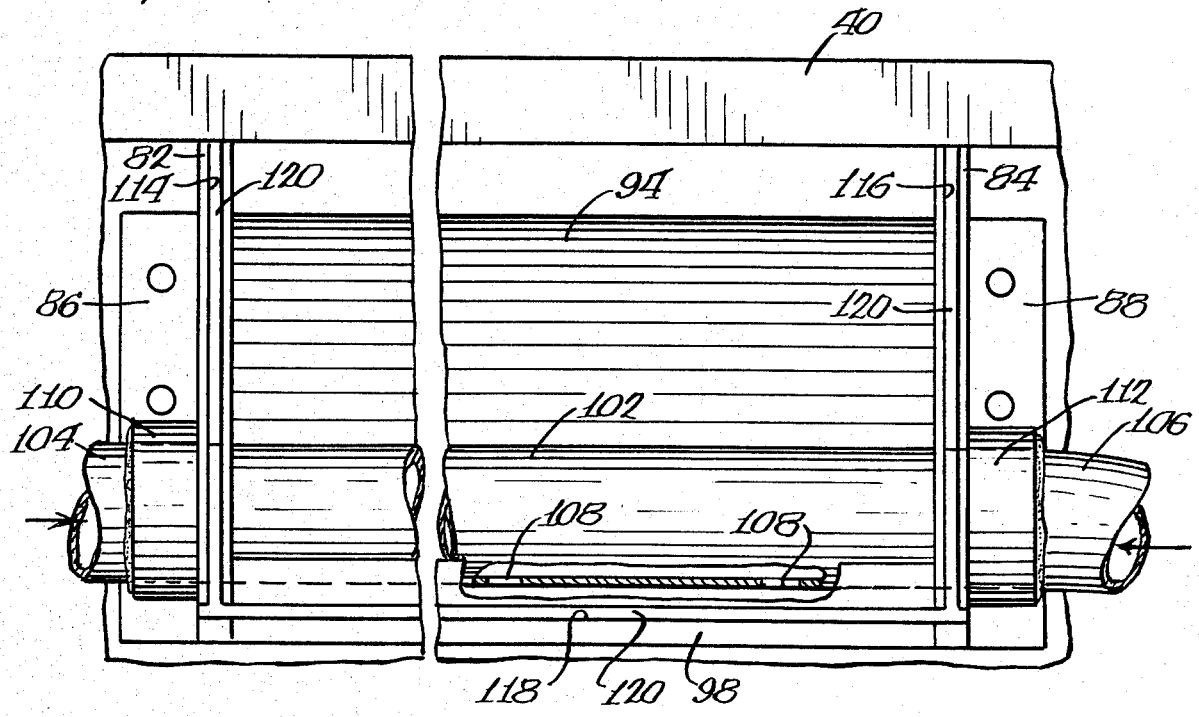

PAPER COATING APPARATUS

BACKGROUND OF THE INVENTION

The present invention relates to apparatus for applying liquid coating material on a moving web of paper, and in particular to an apparatus of the trailing blade type which has an improved structure for applying very uniform coat weights of material on a web of paper.

Conventional coaters of the trailing blade type include means for applying coating material to a paper web that is usually supported and carried by a resilient backing roll, together with a flexible coater or doctor blade located on the trailing side of the applicator, which serves to doctor or level the applied coating. In general, an excess of coating material is applied onto the web and the coater blade then meters or removes the excess while uniformly spreading the coating onto the web surface.

In recent years it has become desirable to produce papers having a minimum amount of coating. To achieve low coat weights with conventional trailing blade equipment it is necessary to increase the pressure of the coater blade against the web, which results in a high rate of wear of the blade and necessitates more frequent blade replacement. High blade pressure also increases the possibility of web breaks and streaking caused by foreign particles caught between the blade and web.

Conventional coaters employ a relatively long dwell or soak time, which is the time interval between initial application and final blading of the coating. As a result, the water portion of the coating composition, as well as the water soluble or dispersible materials contained therein, migrate into the moving web at a more rapid rate than the pigment and eventually cause an undesirable imbalance in the coating constituents and their rheological properties. Long soak periods are also incompatible with the application of successive web coats without intervening drying, because the successive coats tend to migrate into and contaminate the previous coat.

The foregoing problems are discussed in U.S. Pat. No. 3,348,526, issued to Neubauer, wherein a narrow stream of coating is extruded onto an inverted trailing blade that defines a nip region with a supported web. The coating application is such that the coating material is unpressurized after leaving an orifice and being supported on the blade, and the leading side of the coating material stream is exposed to the environs in the zone of application. Since the coating is bladed substantially immediately after application, soak times are kept to a minimum.

To overcome the disadvantages of the aforementioned applicators in applying lightweight coatings on paper, there has been developed a short dwell time applicator as disclosed in U.S. Pat. No. 4,250,211, issued to Damrau et al and assigned to the assignee of the present invention. In that applicator, coating material is introduced in excess into a relatively narrow application zone for being applied on a web carried therethrough. A forward wall of the applicator defines a relatively narrow gap with the web at the upstream end of the application zone, and excess material in the zone overflows through the gap and forms therein a liquid seal, so that coating material in the zone and as applied to the web is maintained under pressure. The speed of the web is adjusted for a relatively short dwell time, and a flexible coater blade doctors the web at the downstream end of the zone, thereby removing excess material from the web and uniformly spreading the material on the web. In consequence of the short dwell time of the pressurized application of coating material on the web, an appropriate yet lightweight amount of coating may be applied without need for high blade pressures.

A requirement in use of conventional applicators, as well as an applicator of the type disclosed in U.S. Pat. No. 4,250,211, is that coating material must be uniformly distributed to the web, so that the coating material is applied very uniformly and doctored evenly to produce a uniform coat weight on the web. Nonuniformity in weight of the coating material impairs the quality of the resulting coated paper, and may even render it unsatisfactory for its intended purpose.

SUMMARY OF THE INVENTION

In accordance with one aspect of the invention, there is provided an improved applicator for applying coating liquid to a moving web of paper. The applicator is of a type including an elongate body defining an elongate chamber therein with an elongate opening thereto positionable adjacent to and transversely across the web, and means for introducing coating liquid under pressure into the chamber for being directed through the opening and onto the web. The improvement is characterized in that the chamber is generally teardrop shaped, has a curved wall opposite from the opening and front and rear walls which converge from the curved wall toward the opening.

The means for introducing comprises an elongate and tubular distribution header in and longitudinally along the chamber and having a plurality of spaced and longitudinally aligned outlet passages, and means for flowing coating liquid under pressure into opposite ends of said distribution header. The curved chamber wall is preferably semicircular, and the distribution header is rotationally oriented so that the outlet passages direct coating liquid toward and against the curved wall, which deflects the coating liquid for flow around opposite sides of the distribution header and through the chamber to and through the opening.

In accordance with another aspect of the invention, there is provided an improved applicator for applying coating liquid to a moving web of paper, wherein the applicator is of a type comprising an elongate body having front and rear relatively movable walls, a base wall between the front and rear walls and end walls at opposite ends thereof. The front, rear, base and end walls define a chamber therebetween and ends of the front and rear walls, generally opposite from the base wall, are spaced apart and define an elongate opening from the chamber positionable adjacent to and transversely across the web, and means is provided for introducing coating liquid under pressure into the chamber for being directed through the opening and onto the web. The improvement is characterized in that the front wall is movable relative to and away from all of the rear, base and side walls to open the chamber, and an integral and resilient seal means is between the front wall and each of the end and base walls for sealing the front wall thereto when the same are moved together to close the chamber.

In accordance with a further aspect of the invention, in an applicator of the general type there is provided a plurality of conduits extending longitudinally along the body for conveying a heat transfer fluid in contact with the body, and means for flowing a temperature controlled heat transfer fluid through the conduits to selectively thermally deflect the body to maintain the elongate opening straight between opposite ends thereof despite bowing or lateral deformations that would occur in the absence of the heat transfer fluid, so that very uniform coat weight profiles may be maintained.

The foregoing and other objects, advantages and features of the invention will become apparent upon a consideration of the following detailed description, when taken in conjunction with the accompanying drawings.

BRIEF DESCRIPTION OF THE DRAWINGS

FIG. 2 is similar to FIG. 1, except that a front wall of the applicator is shown in an open position accommodating access to the chamber for cleaning the same, and FIG. 3 is a partial cross-applicator view taken substantially along the lines 3—3 of FIG. 2, illustrating further details of the distribution header and chamber, as well as an improved seal structure for establishing a fluid tight connection with the front wall when it is closed.

DETAILED DESCRIPTION

Figure 1:
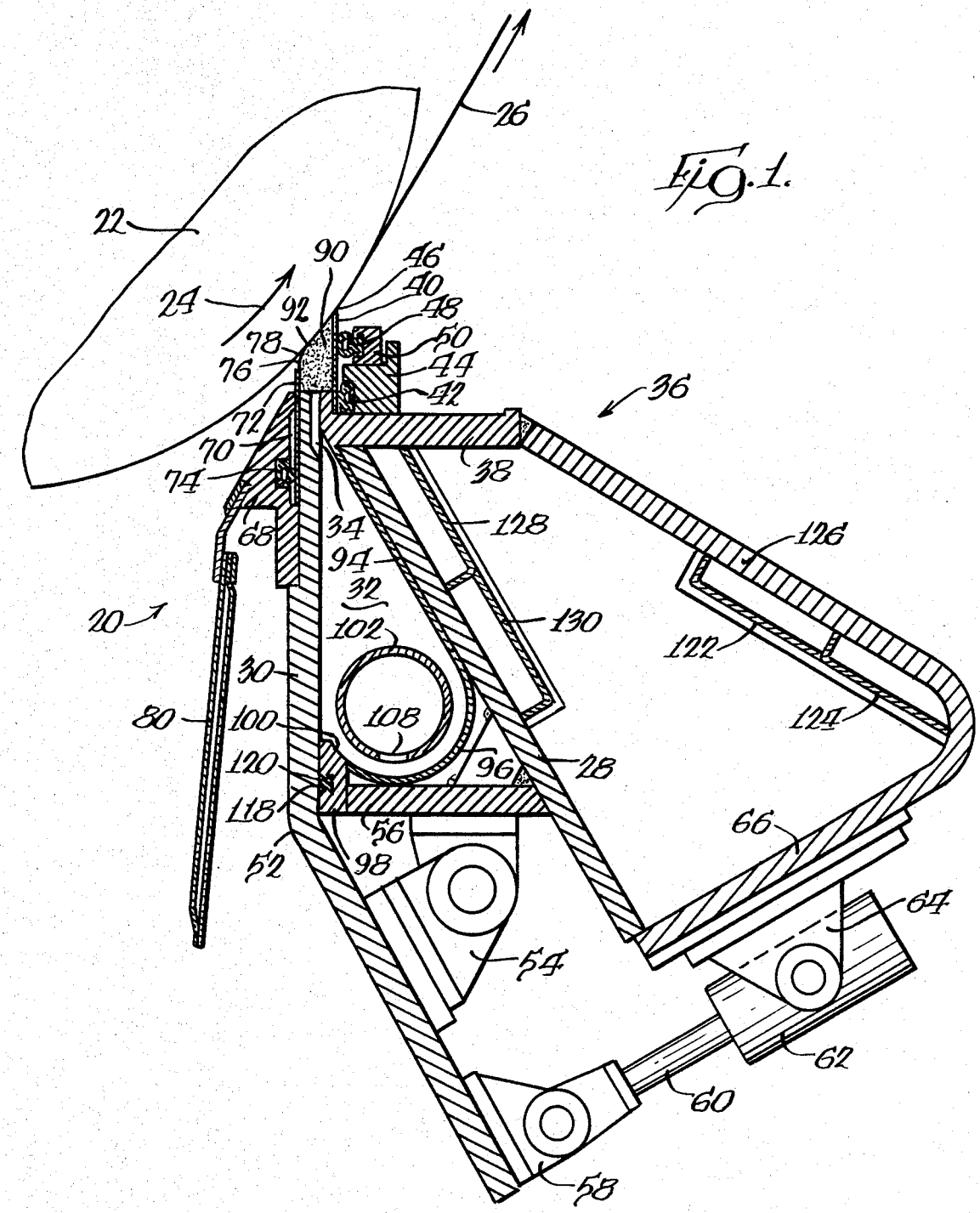
FIG. 1 is a cross sectional, side elevation view of a short dwell time applicator for applying a liquid coating material to a moving web of paper, illustrating the configuration and arrangement of an improved coating material supply chamber and distribution header for very uniformly distributing coating material into an application zone and onto a web of paper moving through the zone to produce a very uniform coat weight on the web.

The drawings illustrate an applicator or coater portion of a paper coating machine, which embodies the teachings of the present invention. Referring to FIG. 1 the applicator, indicated generally at 20, is elongate and extends parallel to and coextensively with a movable support or backing roll 22 which rotates in the direction shown by an arrow 24 and supports a web of paper 26 during its travel through an application zone. The applicator has rear and front walls 28 and 30 forming a coating material supply chamber 32 therebetween for reception of liquid coating material under pressure, and the walls converge upwardly toward one another and define a narrow outlet orifice or metering slot 34 which extends upwardly adjacent to, transversely across and facing the web support surface of the roll 22.

The applicator also includes a main support beam, indicated generally at 36, extending parallel to and coextensively with the backing roll 22. The applicator rear wall 28 defines a front wall of the main beam, which also has a top wall 38 formed into an upwardly extending lip at its forward end. A flexible doctor or coater blade 40 at the downstream end of the application zone is held against a rearward surface of the lip by a pneumatic tube 42 contained within a channel in a support member 44, and the tube is expandable by the introduction of fluid under pressure therein to press against the blade. The blade extends upwardly into engagement with the web 26 supported on the backing roll and serves to meter and level the coating applied on the surface of the web. A tip 46 of the blade is urged or loaded against the web by a second pneumatic tube 48 contained within a channel in an upper support member 50, and the amount of coating applied to the web is influenced by the force of the blade tip against the web.

The front wall 30 is pivotally mounted relative to the rear wall 28 to permit the chamber 32 to be opened for cleaning, as shown in FIG. 2. To that end, the front wall is curved rearwardly at 52, beneath the curve the wall is connected by a hinge 54 to a lower applicator wall 56, and a lower end of the front wall is connected by a hinge 58 to a piston rod 60 of a pneumatic cylinder 62. The cylinder in turn is pivotally connected by a bracket 64 to a main beam bottom wall 66, whereby actuation of the cylinder pivots the front wall between a position closing the chamber (FIG. 1) and a position opening the chamber (FIG. 2).

An elongate orifice plate holder 68 extending transversely of the applicator is mounted on an upper end of the front wall 30 and defines with the front wall and upwardly opening elongate slot 70. An elongate orifice plate 72 is received within the slot transversely of the applicator, rests at its lower end on the bottom of the slot and is releasably secured in the slot by a pneumatic tube 74 received in a channel through the orifice plate holder. The orifice plate converges toward the roll supported web, and has a free upper edge 76 which is juxtaposed to but spaced slightly from the web, such that a space or gap 78 between the edge and the web at a forward, leading or upstream end of the application zone is relatively small and less than one inch. As will be described, excess coating material introduced into the application zone from the chamber 32 and through the metering slot 34 overflows from the zone through the gap 78 and forms a liquid seal in the gap at the forward end of the zone, thereby enabling pressurized application of coating material onto the web in the zone. A splash plate 80 extending downwardly and outwardly from a forward edge of the orifice plate holder guides liquid coating material flowing through the gap into a trough (not shown) for collection and recirculation.

The two side ends of the coating material supply chamber 32 are sealed by end plates 82 and 84 having respective brackets 86 and 88 for mounting the end plates to the rear wall 28 (FIG. 3). At the two side ends of the application zone, the spaces between the coater blade 40 and the orifice plate 72 are sealed off by edge dams 90 (only one of which is shown), which seal with the upper ends of the front wall 30 and forward lip of the wall 38, as well as with the orifice plate, doctor blade and roll supported web 26, thereby to define a generally closed coating material application zone 92 downstream from the metering slot 34 and between the web, doctor blade and gap 78.

To the extent described, the applicator is generally of the type disclosed in detail in aforementioned U.S. Pat. No. 4,250,211, issued to the assignee of the present invention, the teachings of which are incorporated herein by reference. For a more specific description of the applicator, reference is made to that patent.

In operation of the applicator to the extent described and as taught by U.S. Pat. No. 4,250,211, coating liquid is introduced into the chamber 32 under sufficient pressure and in sufficient quantity to completely fill the chamber, the metering slot 34 and the application zone 92 defined by the doctor blade 40, the orifice plate 72 and the end dams 90, to cause a continuous, copious flow of coating material reversely of the direction of web travel through the narrow space or gap 78 defined between the upper edge 76 of the orifice plate and the web. This forms a liquid seal between the edge and the web and causes the coating liquid to be applied to the web in a very narrow transverse band under a constant positive pressure. The copious excess of coating liquid that flows through the gap 78 reversely of the direction of web travel forms a nonabrasive liquid seal with the web at the upstream or forward end of the coating application zone; causes the coating liquid in the zone to be maintained under pressure and to be applied to the web under pressure; seals off the forward edge of the zone against entry of air and foreign matter; strips air from the high speed web and prevents such air from causing streaks or skips in the coating on the web; and causes the coater blade 42 to doctor the coating liquid while the liquid is held under pressure.

In paper coaters of the short dwell time type such as described above and in U.S. Pat. No. 4,250,211, it is important that the applicator incorporate a coating material supply chamber and a coating material distribution header of a design such that coating material is uniformly distributed to and applied on the web and doctored evenly to produce a uniform coat weight. Accordingly, in accordance with one aspect of the invention the coating material supply chamber 32 is of generally teardrop shape and defined within the front wall 30 and an elongate J-shaped member extending transversely of the applicator. The J-shaped member has a planar rear wall 94 abutting the rearward wall 28 and a semicircular lower wall 96 which terminates at an elongate support 98 having an upper semicircular surface 100 which continues the curve of the bottom wall 96. The inside walls of the chamber 32 are smooth to prevent coating buildup, and the tapered side walls 94 and 30 lead into the metering slot 34, the result being that the opposing converging walls tend to gradually accelerate the flow of coating material to the metering slot.

In addition to the teardrop shape of the chamber 32, according to another aspect of the invention there is provided an improved distribution header within the chamber. The distribution header, which is tubular, elongate and extends transversely through the chamber, receives coating liquid under pressure at its opposite ends through supply lines 104 and 106 (FIG. 3), and has a plurality of spaced outlet openings or passages 108 formed therethrough longitudinally therealong. Taken in conjunction with the size and spacing of the outlet openings, on narrow coaters of approximately 200 inches and narrower a three inch diameter distribution header has been found to be sufficient, while with wider coaters on the order of 300 inches the distribution header may need to be about five inches in diameter to convey the larger flows of coating material and uniformly distribute the coating on the web. The semicircular chamber wall 96 and surface 100 are concentric throughout their extent with the distribution header, and the distance between the concentric surfaces is on the order of 0.375" to 0.500", depending on the viscosity of the coating material used. It is contemplated that the dimension would be about 0.375" for low viscosity coating materials (e.g., 3000 cps at 20 RPM Brookfield) and about 0.500" for high viscosity coating materials (e.g., 8000 cps at 20 RPM Brookfield). However, it has been found that a 0.375" dimension is usually optimum.

The distribution header 102 is preferably rotationally oriented within the chamber 32 so that the outlet openings 108 discharge coating material downwardly against the circular bottom wall 96. In consequence, the flow of coating material from the distribution header is uniformly spread out and distributed to opposite sides of the header, and flows around the header into the upper tapered portion of the chamber and thence through the metering slot 34 into the application zone 92 for being very uniformly applied onto the paper web and doctored evenly. The downwardly directed flow also flushes the concentric surfaces to maintain the chamber continuously scoured and clean during operation.

The spacing between the distribution header outlet openings 108 is normally about 10.75" center to center, although the dimension can vary about 1.0" depending on the coating material formulation and rheology used. The diameter of the openings preferably ranges from about 0.625" to 0.875", although the use of 0.750" diameter openings has been found to be particularly advantageous. All of the openings need not be of the same diameter, and several may be either larger or smaller toward the center of the distribution header to facilitate uniform distribution with some coating formulations. The distribution header is rotatably adjustable within the chamber 32 to direct the flow of coating material from the openings in any direction radially outwardly from the header, although it is contemplated that in normal operation of the applicator the direction of discharge will usually be downward. Opposite ends of the distribution header are provided with collars 110 and 112, which can be removed to accommodate lateral removal of the distribution header from the chamber through the end plates should there be a need to change the size of the outlet openings or their spacings.

A further aspect of the invention relates to a structure for sealing the movable front wall 30 with each of the end plates 82 and 84 and the elongate support 98 to seal the chamber 32, and to that end seal retaining grooves 114, 116 and 118 are respectively formed in and along the front faces of the end plates 82 and 84 and the elongate support 98. As seen in FIG. 3, the three grooves are continuous and together are generally U-shaped or configured as an open sided rectangle, and from FIGS. 1 and 2 it is seen that the grooves lie in a common plane and opposite side walls of each groove define a generally triangular protuberance. The grooves are adapted to receive a unitary, U-shaped and square cross sectioned elastomer seal 120, such as of neoprene or Buna N, and the shape of the grooves are such that they hold or grasp the sides of the seal and retain it without need for adhesives or retaining devices. Consequently, a continuous square cross section seal strip 120 inserted into the grooves 114, 116 and 118 provides a fluid tight connection between the movable front wall, the end plates and the elongate support without need for joints or splices in the seal. The seal strip preferably has a continuous circular passage formed therethrough along its length to facilitate insertion of the seal into the grooves, and the result is that the structure provides a simplified, fluid tight seal for the coating material supply chamber when the front wall is closed, so that in operation of the applicator there is no or at most minimal leakage of coating material from the chamber.

As is known, because of the relatively large transverse extent of paper coating applicator, if there are slight deviations in manufacturing the same or perhaps as a result of heating during use, it often happens that the applicator deflects or bows between its side ends, resulting in nonuniform doctor blade pressure on the paper web and attendant nonuniform coating material weight. Accordingly, the invention also contemplates providing two channels 122 and 124 along and adjacent to a lower inner surface of a back wall 126 of the main beam 36, and a pair of channels 128 and 130 along and adjacent to the upper end of the rearward wall 28. Means (not shown) are also provided for introducing cooled and/or heated fluid medias into the various channels, so that by controlling the temperature of the medias the applicator and main beam can be deflected in a controlled manner to obtain an applicator straightness from side to side of the web and thereby produce uniform coat weights even with wide coater heads. Although not shown, similar channels may be provided along the top and bottom main beam walls 38 and 36 to also enable controlled deflection of the main beam along a plane generally perpendicular to the plane of deflection afforded by the channels 122, 124, 128 and 130.

While embodiments of the invention have been described in detail, various modifications and other embodiments thereof may be devised by one skilled in the art without departing from the spirit and scope of the invention, as defined in the appended claims.

What is claimed is:

1. An improved applicator for applying coating liquid to a moving web of paper, wherein said applicator is of a type comprising an elongate body having front and rear relatively movable walls, a base wall between said front and rear walls and end walls at opposite ends thereof mounted on said rear wall, said front, rear, base and end walls defining a chamber therebetween and ends of said front and rear walls, generally opposite from said base wall, being spaced apart and defining an elongate opening from said chamber positionable adjacent to and transversely across the web; and means for introducing coating liquid under pressure into said chamber for being directed through said opening and onto the web, the improvement being characterized in that said front wall is movable relative to and away from all of said rear, base and end walls to open said chamber, and a seal means is between said front wall and each of said end and base walls for sealing said front wall thereto when the same are moved together to close said chamber.

2. An improved applicator as in claim 1, wherein mating surfaces of said front wall and each of said base and end walls substantially lie in a common plane when the same are moved together to close said chamber, and wherein said seal means comprises a unitary seal element extending along one of said mating surface of said front wall and said mating surfaces of said base and end walls.

3. An improved applicator as in claim 2, wherein said seal element is resilient and configured complementary to said mating surface of said front wall and said mating surfaces of said base and end walls.

4. An improved applicator as in claim 3, wherein a continuous groove is formed in one of said mating surface of said front wall and said mating surfaces of said base and end walls and said seal element is received in said continuous groove.

5. An improved applicator as in claim 4, wherein said continuous groove is a generally rectangular continuous channel in one of said mating surface of said front wall and said mating surfaces of said base and end walls, said channel having side walls defining generally triangular shaped protuberances which extend toward but spaced from each other from opposite sides of said channel, and said seal element is rectangular in cross section and is pressed into said continuous channel, said protuberances retaining said seal element in said continuous channel.

6. An improved applicator as in claim 5, wherein said continuous channel is formed in said mating surfaces of said base and end walls.

7. An improved applicator as in claim 5, wherein said continuous channel and integral seal element are configured complementary to each other and to an open sided rectangle.

8. An improved applicator as in claim 1, including a plurality of conduits extending longitudinally along said body for conveying a heat transfer fluid in contact with said body, and means for flowing a temperature controlled heat transfer fluid through said conduits to selectively thermally deflect said body to maintain said elongate opening straight between opposite ends thereof despite bowing or lateral deformations that would occur in the absence of the heat transfer fluid.

9. An improved applicator as in claim 8, wherein said plurality of conduits comprise a first plurality of conduits on said body toward said opening and a second plurality of conduits on said body away from said opening.

10. An improved applicator as in claim 9, wherein each of said first and second plurality of conduits comprises a pair of conduits.

11. An improved applicator for applying coating liquid to a moving web of paper, wherein said applicator is of a type including an elongate body defining an elongate chamber therein with an elongate opening thereto positionable adjacent to and transversely across the web; and means for introducing coating liquid under pressure into said chamber for being directed through said opening and onto the web, the improvement being characterized in that said chamber is generally teardrop shaped, has a curved wall opposite from said opening and front and rear walls which converge from said curved wall toward said opening, said means for introducing comprises a distribution header within said chamber intermediate said opening and curved wall, said distribution header having outlet passages, and means for flowing coating liquid under pressure into said distribution header for flow through said outlet passages into said chamber, wherein said distribution header is spaced from said front, rear and curved walls and said outlet passages direct coating liquid toward and against said curved wall, said curved wall deflecting the coating liquid for flow around opposite sides of said distribution header and through said chamber to and through said opening, said body including end walls mounted on said rear wall at opposite ends of said front, rear and curved walls, and wherein said front wall is movable relative to and away from all of said rear, curved and end walls to open said chamber, and a seal means is between said front wall and each of said end and curved walls for sealing said front wall thereto when the same are moved together to close said chamber.

12. An improved applicator as in claim 11, wherein mating surfaces of said front wall and each of said curved and end walls substantially lie in a common plane when the same are moved together to close said chamber, and wherein said seal means comprises a unitary seal element extending along one of said mating surface of said front wall and said mating surfaces of said curved and end walls.

* * * * *